United States Patent [19]

Roux et al.

[11] Patent Number: 4,484,925

[45] Date of Patent: Nov. 27, 1984

[54] TANNING METHOD DESIGNED TO MAKE LEATHERS MYCOSTATIC, ANTIMYCOTIC, AND ANTIFUNGAL, AND THE RESULTING PRODUCTS

[76] Inventors: Joël Roux, Le Grand Parc - Rue Loire, 26100 Romans; Auguste Grawitz, 16, Avenue de la Saulaie, 38160 St. Marcellin, France

[21] Appl. No.: 493,727

[22] Filed: May 11, 1983

[30] Foreign Application Priority Data

May 12, 1982 [FR] France ..... 82 08615

[51] Int. Cl.[3] ..... C14C 3/04; C14C 3/02

[52] U.S. Cl. ..... 8/94.26; 8/94.2; 8/94.21

[58] Field of Search ..... 8/94.26, 94.2, 94.21

[56] References Cited

U.S. PATENT DOCUMENTS 2,358,402 9/1944 Kurlychek ..... 8/94.21
3,010,780 11/1961 Plapper ..... 8/94.26
3,520,976 7/1970 Buckman et al. ..... 8/94.27
4,035,146 7/1977 Brenner et al. ..... 8/94.21

FOREIGN PATENT DOCUMENTS 2364969 4/1978 France .
817101 7/1959 United Kingdom .

*Primary Examiner*—Maria Parrish Tungol
*Attorney, Agent, or Firm*—Ostrolenk, Faber, Gerb & Soffen

[57] ABSTRACT

The invention relates to the tanning of leather.

The tanning method according to the invention, which is designed to confer on the leathers and hides biostatic properties without migration of the active agent, involves tanning the leathers and hides with non-soluble basic metallic complexes formed in situ, and on which have been fixed one or more biocidal agents.

The invention finds an application in the manufacture of shoes.

9 Claims, No Drawings

TANNING METHOD DESIGNED TO MAKE LEATHERS MYCOSTATIC, ANTIMYCOTIC, AND ANTIFUNGAL, AND THE RESULTING PRODUCTS

The present invention relates to the tanning of leathers and more particularly those leathers intended for the clothing industry, and even more particularly leathers for use in the manufacture of shoes.

Formerly, leathers and skins were tanned with vegetable extracts, and normally with extracts from oak-trees and chestnut-trees which were used in large quantities. These tanning agents are known for their antiseptic properties.

An excess of these tanning agents incorporated to the leather had the effect of producing an "exuding" effect through perspiration.

The antiseptic function of these products within the leather was thus indirectly transmitted to the skin and permitted prevention of the germ or yeast from developing.

The modern tanning methods have abandoned the vegetable tanning agents to use mineral ones permitting a speed up the tanning process and by way of consequence to lower its cost and to produce leathers and hides of good overall qualities, i.e. soft, strong and pleasant to the touch.

If these leathers are satisfactory from many points of view, they have now been found to be responsible for the development of mycoses or other skin diseases which are becoming more and more frequent.

Indeed a considerable increase of mycoses have been noted and in particular mycosis of the feet, despite the many products sold against it.

Research conducted on the subject has revealed that a correctly-treated mycosis of the feet reappears immediately the subject wears again shoes which have already been used. It was thus found that the fact of wearing again shoes which had already been used has the effect of placing the skin in indirect contact with the leather through natural perspiration. The mycotic germs which are present on the surface of the leather of the shoe thus find a natural vehicle of development which returns them to the contact with the skin on which they can once again multiply and survive.

These discoveries have incited researchers to find a way to fight such a transmission, in order to prevent the necessity of having to destroy the new and hardly worn shoes responsible for the recontamination of a mycosis which had been treated and cured.

To this effect, it has been proposed to impregnate the support with appropriate agents having a bactericide, fungicide or like action. Such products are generally applied by any suitable means over the surface of the leathers due to come into indirect contact with the skin. Besides the fact that these products are generally responsible for giving out more or less characterized and persisting smells, it has also been found that their antimycotic activity did reduce with time, considering that said products are not fixed to the leather. After use, said products were known to be sort of "exuded" and to disappear from the surface of the leather on which they had been applied.

The expected effect therefore was rapidly disappearing and the recontaminating mycoses reappearing.

Another disadvantage of these products is that they are generally responsible for burns, dermatitis, allergies, which can be defined as iatrogenic diseases corresponding to the accidents caused by the absorption through the skin of antimycotic and fungicidal products. These iatrogenic diseases are known to take various forms going from a light burn to serious and complex allergies.

It is an object of the present invention to overcome the aforesaid disadvantages by proposing a new tanning method to make leathers and hides permanently mycostatic and antimycotic, without any risk of allergy, even when the products manufactured with such leathers and hides are worn intensively and frequently.

Another object of the invention is to propose a new tanning method which, to achieve the aim of the invention, includes a treatment phase which is applicable, without losing any of its efficiency, at any stage in the actual tanning operation, i.e. any time between the bating and the finishing operations.

Yet another object of the invention is to propose a new tanning method which can be used for any types of leathers and hides, without any risk of the required main qualities, i.e. fineness, softness, mechanical strength, etc., being altered.

The method according to the invention confers mycostatic properties to the leather by fixing an antiseptic agent on the fiber of the leather by means of an insoluble metallic complex, with basic functions giving it tanning properties.

According to the method of the invention, it is possible to tan leathers and hides with non-soluble metallic complexes formed in situ and on which antiseptic, bactericidal, fungicidal, germicidal, antimycotic and more generally biocidal agents can be fixed in order to give them a mycostatic, bacteriostatic, fungistatic or more generally biostatic power.

These non-soluble basic metallic complexes which have a tanning activity can be formed in situ on the fiber or reacting two water-soluble salts, or by fixing a salt non-soluble in water but soluble in an emulsible solvent and of course having the aforementioned basic character.

The same applies to the biocidal or antiseptic agent which can be used in water-soluble form or in a solvent. In both cases, it will react with the free basic functions of the non-soluble tanning metallic complex in such a way as to be fixed thereon in a non-soluble form.

This method can be used on its own or in combination with other conventional tanning agents such as metal salts of chromium, iron, aluminium, silica, zirconium, etc. having tanning properties, or with vegetable or synthetic tanning agents already known as such. Said method can be used in pre-tanning, tanning or retanning.

The manufacturing principle is as follows:

the metal salt used has antimycotic and bactericidal properties as well as a certain tanning power, such as for example zinc, copper, silver, etc., avoiding those with too much toxicity such as mercury, lead . . . or the radioactive ones.

most of these metals have the disadvantage of forming complexes which are only stable with the collagen of the leather when the pH's are alkaline. Therefore, to obtain a tanning which is irreversible under the pH's conventionally found in the leather industry, said metals are converted into basic non-soluble complexes with, however, a great affinity for the collagen, owing to anions specific for each one.

Through the text, the anions will be re-grouped under (A) or (A−) and a non-specified anion will be (a) or (a−) or more generally and precisely ($a^n-$).

Likewise, the cations, will be re-grouped under (C) and one non-specified cation will be (c) or according to the protocole adopted for the anions ($c^m+$).

The basicity will be indicated in an overall formula by a basic group (OH) capable of forming, by dissociation of the product, an ionic or ionized particle (OH).

(M) will represent all the antimycotic antibacterial or bactericidal, antifungal or fungicidal, and even antiseptic or biocidal agents. An antiseptic from that list, which will be non-specified will be indicated by (m) in a general or overall application.

The list of anions (A), cations (C) and antiseptics (M) concerned by this method is given hereunder:

List of Anions (A) giving advantageous compounds for the tanning of mycostatic leathers:

Sulphur derivatives: sulphate, thiosulphate, sulphites, hydrosulphites, sulfides, Selenium derivatives: from selenates to selenides, Tellurium derivatives: from tellurates to tellurides, Phosphorous derivatives: phosphates, phosphites, phosphides, Silicon derivatives: mainly silicates, fluosilicates and derivatives, Tin derivatives: mainly stannates and derivatives thereof, Bismuth derivatives: bismuthate and derivatives, Cited for information only, because too toxic: arsenates, antimonates and cyanide derivatives. Monovalent acids derived from fluorine, chlorine, iodine and bromine are not to be considered as advantageous except with tri- or tetravalent metals. The same applies to nitrogenous anions which are not monovalent, with the same reservations.

List of Cations (C) giving advantageous compounds for tanning mycostatic leathers:

Only the lithium, sodium, potassium, rubidium and cesium which are monovalent and as a result cannot give basic salts, are classed as unsuitable for this method. Radon has been eliminated because it is non-valent or zero-valent and therefore non-reactive and incapable of giving salts.

Not recommended, even though they can give complexes meeting the conditions of the method,—the following radioactive metals: technetium, prometium, francium, radium, actinium, thorium, protactinium, uranium, polonium and astatine, and the following toxic heavy metals because of their toxicity: mercury, cadmium and lead.

Are classed as suitable but too expensive: scandium, germanium, gallium, niobium, yttrium, ruthenium, rhodium, palladium, terbium, praeseodynium, neodymium, holmium, erbium, samarium, thulium, eruopium, ytterbium, gadolinium, lutecium, hafnium, tantalum, rhenium, osmium, gold, iridium and platinum.

Especially classed as suitable: titanium, vanadium, manganese, cobalt, nickel, molybdenum, tungsten, thallium, bismuth, indium, tin, beryllium, magnesium, calcium, strontium and baryum.

Classed as usable according to the invention (although their tanning properties in hydroxide form are known and used): chromium, iron, zirconium and aluminium used in the form of non-soluble basic complexes.

Finally, the preferred cations, used on their own or mixed with others are: copper, zinc and silver because of their antiseptic properties.

List of antiseptics (M) usable in the methods for obtaining mycostatic leathers by tanning with non-soluble metallic complexes:

Because of the proliferation of antiseptics on the market, all the antiseptics capable of being fixed on the non-soluble and basic metallic complexes, can be added to the following list subject to prior control.

Naphtenic acid and its salts, dimethylthiocarbamic acid and its salts, 2-mercaptobenzothiazol and its salts, diethyldithiocarbamic acid and its salts, dimethyldithiocarbamates, ethylene, dithiocarbamate, ethylxanthate, isopropylxanthate, ethylphenyldithiocarbamate, undecylenic acid and undecylenates, hydroacetic acid and dehydroacetates, phenoxyacetic acid and phenoxyacetates, nitrophenoxyacetatic acid and nitrophenoxyacetates, cresylic acid (cresol) and cresylates, bensuldazic acid and and bensuldazates, 2-phenylphenol and its salts, pentachlorophenol and its salts, tetrachlorophenol, triphenylantimony, triphenylbismuth, trimethyl-tin, paranitrophenols, and paranitrophenates, 3-methylchlorophenol (p. chlorometaxylenol,) chloromercuriphenol (mercurobutol) and chloromercuriphenates, salicyanilide, griseofulvin, amphotericin, nystatin (Mycostatin), flucytosine, siccanin, bacitracin. Capilin (essential oil of Artemesia Capillaris), 0-chloro$\alpha,\alpha$-diphenylbenzylimidazole, miconazole, (Daktarin), econazole (pevaryl), haloprogine, 2-chloro-4-nitrophenol, 1,2bis-(ethoxycarbonylthioureido)=benzene(-thiophanase), 6-chloro, 1,2-benzoisothiazoline-3-one (ticlatone) fongeryl, gentian violet, eosin and eosinates, etc.

The number and substances are not limited. What is important is the way in which the antiseptic is bonded to the leather fiber via a non-soluble and tanning basic complex.

From these criteria, and adapting the language of modern mathematics as applied to chemistry, it is possible to write the formula of a non-soluble basic metallic complex (c,a,OH), its tanning action (collagen or leather) U (c,a,OH) and the final complex giving a mycostatic leather in the U (c,am) form (leather), "U" being the mathematical symbol of the union.

This writing method enables to demonstrate the tanning action of the non-soluble metallic complex and its mycostatic and bacteriostatic function.

How to obtain non-soluble and basic metallic complexes:

The in-situ production of basic non-soluble metallic complexes (c,a,OH) proceeds from a chemistry law:

$$\text{salt}+\text{salt}=>\text{salt}+\text{salt}$$

everytime one of the salts which has formed in the second member can be eliminated from the solution by precipitation or by evaporation. Therefore:

$$a^1c^1+a^2c^2=>a^1c^2+a^2c^1$$

can be written everytime $a^1c^2$ or $a^2c^1$ evaporates or precipitates. In the present case, the interesting action is the precipitation. It is possible in certain cases to produce the joint precipitation of two compounds which have formed. By way of example:

$$Zn(SO_4)+BaS=BaSO_4+ZnS$$

in which reaction the barium sulphate and zinc sulphide, which are formed from zinc sulphate and barium sulphide, precipitate together.

In this text, the precipitated complexes have been defined as basic. This feature is very useful in the tanning industry to permit an efficient tanning. It is precisely that basicity which gives such a character to cations such as chromium, iron, alumina, zirconium and silicium, etc. In the mineral tanning methods using metals, the tanning is achieved by metal hydroxides. Trivalent and sometimes tetravalent cations are used and no other. Contrary to the method according to the invention, agents known as "masking" agents are used which do not render insoluble the basic forms but on the contrary make them soluble. However, the tanning factor remains the basicity and polyvalence equal to or greater than 3 which makes it possible to cross-link or to three-dimension the bonds between the fibers of the collagen by cationic bridges and this in static manner.

A tanning by the cationic hydroxides can be expressed by the conventional means (c,OH) and in tanning becomes (leather) U(c) if (c) is tri- or tetravalent. Study of the different salts formed between an anion and a cation:

An anion can be defined qualitatively by the number of electronegative charges per molecule. For example:

($a^-$) monovalent or monoacid anion ($a^{--}$) bivalent of biacid anion and by extension, ($a^{m-}$) polyvalent or polyacid anion The same applies to cations (c), ($c^+$) monovalent or monobasic cation, ($c^{++}$) bivalent or bibasic cation, ($c^{n+}$) metallic polyvalent or polybasic cation or ion.

For the notion of basicity to appear, it is necessary to extract ($OH^-$) from the group of anions (A) and even from the sub-group ($A^-$). From thereon, there is a rule: the number of salts which it is possible to produce between an anion and a cation is equal to the sum of acidities (number of valences) and the sum of basicities (valences) less one. For example with ($a^{m-}$) and ($c^{n+}$), the number of salts $=m+n-1$.

For example, between the phosphoric acid, triacid and tribasic chromium, it is possible to form 5 salts: 2 acid, one neutral and 2 basic. It appears that the number of basic salts is always equal to $n-1$ and that of the acid salts to $m-1$.

In the case of the invention, the formation of the basic salts in the non-soluble complexes requires no action wherein $n=1$, i.e. $n-1=0$. Therefore, all metals from the alkaline group, i.e. lithium, sodium, potassium, rubidium and cesium should be eliminated from the method.

Also to be eliminated are the monovalent or monoacid anions such as fluorides, chlorides, bromides iodides (see list hereinabove).

The anions can be introduced in the final composition either as soluble salts giving directly a non-soluble basic complex, or they can be obtained by reacting certain compounds in order to obtain the required one, or else via the step of a third solvent which will be reacted in solution or emulsion.

For example, starting with the sulphide anion ($S^{--}$), it is possible to obtain: $Na_2S+2ZnSO_4+2NaOH==>Zn_2S(OH)_2+Na_2SO_4$ or $BaS+Ba(OH)_2+2ZnSO_4==>Zn_2S(OH)_2+BaSO_4$.

It is possible to obtain a similar result with hyposulphite $2ZnSO_4+S_2O_3Na_2+NaOH==>Zn_2S(OH)_2+3Na_2SO_4+H_2O$.

And the same object can be reached by adding oxalic acid $2ZnSO_4+S_2O_3Na_2+6C_2O_4H_2+NaOH=>Zn_2S(OH)_2+3Na_2SO_4+12CO_2+7H_2O$.

To obtain more weight, it is possible to introduce barium salts (Ba) into these last two reactions, to convert the $Na_2SO_4$ into $BaSO_4$ which is insoluble.

Fixation of the complex on the leather:

The fixation of the basic complex can be expressed in the two ways, i.e. in the form of a chemical equation:

$$\text{collagen} + C_xA_y(OH)_z \longrightarrow \text{collagenate } C_xA_y(OH)_{z-1} + 1\ H_2O.$$

The greater 1 is, the bigger the tanning effect. A real cross-linking occurs and even in certain cases, a cross-linking of the collagen by converting it into leather.

Fixation of the antiseptic (m) on the complex after its fixation on the collagen:

The tanning effect of the non-soluble basic mineral complex can be expressed in the language of modern mathematics, i.e.

$$\text{collagen } UC_xA_y(OH)_z-H_20\times 1$$

For the fixation of (m) to be real, $z-1$ should not be $\phi$ or $z-1=1$.

The method leads to a mycostatic action. It is therefore necessary for the antiseptic product or products belonging to (M) to be fixed on the collagen, and therefore on the leather fibers via the non-soluble basic metallic complex. This bonding should be really chemical. It should occur due to the free basic groups (OH). This therefore implies the necessity to have $z-1=1$.

The list of antiseptics (M) suitable for this use has been given hereinabove.

The final formula of the mycostatic leather obtained by the method according to the invention can be summed up in the following formula:

$$\text{collagenate of } (C_xA_yM_{(z-1)})$$

When in this formula, the cations are designated by C and not c, it is possible to use more than one at a time. The same applies when anions are designated by A and not (a) as well as for the antiseptics of the group defined by (M). The fact of using different cations, anions and antiseptics does not in any way modify the characteristics of the present method. The number of each one is not limitative.

In this group, the complex (c,m) gives all the reactivity needed to the antiseptic (m) to confer the mycostaticity to the leather fibers by tanned the couple (c,a).

Definition of the Mycostaticity:

By mycostaticity of a support, in this case the leather fibers coming from the suitably tanned collagen, is meant the property by which microbes, bacteria, yeast or fungi can neither grow nor survive on contact. Mycostaticity further implies that there is no "exuding" or spreading of the antiseptic bactericidal, fungicidal and other biocidal agents (m) around the support. This precaution is necessary in order to prevent the human body in contact with this support from being subjected to possible burns, dermitis or allergies however slight, even though the contact may be indirect, such as for example through a sock or a stocking. From the moment there is an "exuding" effect, and even the slightest spreading, this means that there is sufficient migration to cause an antibacterial and antimycotic action which can reach the human body and causes burns, dermitis, allergies and other iatrogen diseases thereto. These inconvenients have been noted by different professional technical organizations.

Control of the mycostaticity:

From that definition, there are two types of tests to demonstrate that the microbes, bacteria, yeasts and fungi can neither multiply nor survive in contact with these leathers and other supports containing leather fibers treated in this way. It will also be necessary to control that the antiseptic (m) used does not "exude" or migrate or spread.

These tests can be summed up as follows:

(1)—Place on the sample of leather to be controlled, a piece of knitted material impregnated with a culture of the microbes, bacteria, yeasts or fungi which are most often found in human mycoses, such as for example pseudomonas (*P. aeruginosa*) or staphylococcus (*S. aureus-S. epidermidis*) for the bacteria, candida (candida albicans and others) for the yeasts and tricophytons (*T. mentagrophytes, T. rubrum, T. pedis*) and epidermophytons (*E. floccosum, E. scopulariopsis brevicaulis,* etc.) for the fungi.

The knitted material is held in contact with the leather for 12 hours in a 100% humid atmosphere and at a temperature of 37° C. The material is then separated from the leather and left for 12 hours at 20° C. and at a humidity of 60%. After microbial impregnation and drying, the pieces of leather will be placed in the culture broth which is most favorable to the tested strain, at the pH and temperature most favorable to the growth of each one of the species. With a really mycostatic leather, there should not be any bacterial growth (negative test). To work out how the efficiency of the product lasts out with time, several cycles of impregnation/drying will be conducted.

(2)—Since the test under (1) can prove negative with free antibacterial, antimycotic or antifungicidal antiseptics, it is necessary to control whether the material is really mycostatic and not just antiseptic by a simple pulverization or impregnation of a bactericidal or fungicidal product. A sample of leather is placed in a PETRI box with the most suitable culture broth for the tested strain, and the selected bacterial yeasts and fungi are introduced, even on the sample of leather. The culture should develop over the whole surface of the box except in contact with the leather, above and underneath. If by chance a halo of non-proliferation of the culture occurs around the sample of leather, it means that there is a migration of the active product. This migration can be called spreading or "exuding". It results in the departure of the active product, which is often active at low concentration. The fact that the product has retained its biocidal activity is not a proof of non-migration.

An even stricter test is required to check the merits of a mycostatic quality. A finely ground sample of the leather to be tested is placed in a SOXHLET shell, and 50 or 100 or more filling/emptying cycles are effected with water.

After this series of washes, the resulting extract is examined using very sensitive detection methods (such as an infrared spectrophotometer). Tests can also be conducted on adequately chosen culture broths. With truly mycostatic leathers, the results should be negative in either case. The advantage of infrared spectrophotometry is to be able to control whether the biocidal compounds has migrated. It is moreover possible to control the quality of the tanning fragment by the mineral complex, and even the fixation of other products used in the tanning.

Laboratory tests have been conducted with the different cations of the group (C) jointly with the anions of list (A) and the various antiseptics of list (M).

The different tests have been conclusive. But, for reasons of more available supplies, and also because they were found to have in themselves antiseptic qualities, the following cations were selected preferably for these tests: zinc, copper and silver. Lead, mercury and cadmium were rejected despite their results because of their toxicity, as well as radioactive metals.

As regards the anions, the direct and indirect sulphides, the phosphates and borates as well as the silicates will be preferably selected from list (A).

Amongst the antiseptics from list (M), the dimethylthiocarbamate, undecylenic acid and 2-phenylphenol will be preferably selected. The results with minimum quantities being excellent.

The tanning process can be applied in one or more steps at the different stages of the production:

pre-tanning,
tanning proper,
retanning,
as dye-sediment,
as tawing adjuvant, whether with mineral tanning agents (chromium, aluminium, iron), or with synthetic or vegetable tanning agents, including those having undergone most varied or associated pretannings.

The following examples are given non-restrictively to illustrate the invention.

EXAMPLE 1

Pretanning weigh the hides,
introduce into the fuller:

| | |
|---|---|
| water | 80% |
| zinc sulphate | 4% |
| copper sulfate | 5% |

set the fuller turning until the salts have dissolved and introduce the hides,
set the fuller turning for one hour,
check penetration by making a cut in the hide, With pickled hides, add to the initial solution 6% to 8% of salt (sodium chloride=NaCl) and dissolve same completely before introducing the hides.

then add:

| | |
|---|---|
| sodium hydrosulphide | 4% |

turn to obtain a homogeneous pH of 7.0 in the bath and in the hide.

With pickled hides, this pH will be obtained by adding bicarbonate of soda dissolved in hot water (60° C.). This quantity of bicarbonate is dependent on the composition of the initial pickling.

It is possible to replace the hydrosulphide with a phosphate, or a polyphosphate, and even a silicate.

Then the hides are retanned with chromium, or with a vegetable or synthetic tanning agent.

The fungicidal agent selected from the aforesaid list can be added, after neutralization to a pH of 7.0 or after the retanning, generally in sodium salt form. It is also possible to mix it with the tawing before or after retanning.

EXAMPLE 2

Mineral tanning in the fuller

Raw material: pickled hides.
weigh the hides,
introduce into the fuller:

| | |
|---|---|
| water | 80% |
| salt (NaCl) | 6% |
| set the fuller turning to dissolve the salt, introduce the hides and add: | |
| chromium sulphate of 32° Sch | 10% |
| Zinc oxide | 3% |

set the fuller turning until dissolution of the zinc oxide and a homogeneous pH of 3.5
add:

| | |
|---|---|
| hyposulphite of soda | 3% |
| Turn for 30 minutes, add: | |
| barium chloride | 6% |
| turn for 30 minutes, add: | |
| sodium bicarbonate | 3% |
| turn for 30 minutes pH 7.0. | |

It should be noted that the chromium sulphate 32° Schrlemmer has the formula Cr $(SO_4)$ OH $Cr_2$ $(SO_4)_3$=0° and Cr $(OH)_3$=100° Sch. and $Cr_2$ $(SO_4)$ $(OH)_4$=66° Sch. This scale is internationally adopted. During the tanning, the chromium oxide settles on the leather fiber and releases the sulphuric acid which dissolves in the zinc oxide forming a zinc sulphate. This is induced in the notion of tanning.

EXAMPLE 3

Retanning of Extra White Leather in the fuller

Raw material: Shaved Wet Blue hides.
weigh the hides, place them in the fuller and add:

| | |
|---|---|
| Water | 250% |
| Salt (NaCl) | 18% |
| Set the fuller turning until the salt has dissolved, add: | |
| oxalic acid | 4 to 5% |
| depending on the desired effect turn for 10 minutes, leave in contact for 40 minutes and turn for 10 minutes, in all 60 minutes, empty the bath, rinse for 10 minutes with cold running water, drain for 10 minutes and prepare another bath: | |

| | |
|---|---|
| water | 80% |
| Zinc oxide | 2.6% |
| zinc sulphate | 5.75% |
| duration 60 minutes (check that zinc oxide has dissolved) and add: | |
| hydrosulphide | 1.76% |

-continued

| | |
|---|---|
| set the fuller turning for 15 minutes and add: | |
| baryum chloride | 6.0% |
| turn for 15 minutes and add: | |
| synthetic tanning agent of type SYNEKTAN PM (Registered mark) | 2% |

set the fuller turning for 30 minutes, leave to stand still all night in the fuller, then turn for 15 minutes, empty the bath,
rinse for 10 minutes with water (60° C.) and prepare a new bath:

| | |
|---|---|
| water 65° C. | 80% |
| neat's-foot oil | 1.6% |
| undecylenic acid | 0.5% |
| 2-phenylphenol | 0.2% |
| emulsifying agent of type SANDOLIX WWL (Registered mark) | 4.9% |
| alkaline lithophone | 6.0% |
| turn for 60 minutes and add synthetic tanning agent of type: | |
| SYNEKTAN PM (Registered mark.) | 8.0% |
| discontinuous rotation for 90 minutes, empty the bath and then bring out the hides after rinsing in cold water, and lay out to dry. | |

If the leather is designed to be in dark colors, it is recommended to replace all or part of the zinc sulphate with copper sulphate. The dyeing and tawing operations can be carried out without intermediate drying.

EXAMPLE 4

Vegetable retanning of leathers in the fuller

Weigh the wetted hides,
place them in the fuller with:

| | |
|---|---|
| water | 80% |
| oxalic acid | 4% |
| discontinuous rotation for 60 minutes empty the bath, drain for 5 minutes and prepare new bath: | |
| water | 80% |
| zinc sulphate | 6% |
| turn for 60 minutes and add: | |
| sodium hyposulphite | 3% |
| set the fuller turning for 60 minutes, empty the bath, rinse for 10 minutes, water at 65° C., drain for 5 minutes and prepare new bath: | |
| water 65° C. | 80% |
| emulsifying agent type SANDOLIX WWL (Registered mark) | 3% |
| sodium salt of 2 phenyl-phenol | 0.3% |
| turn for 20 minutes, add: | |
| formic acid | 0.5% |
| set the fuller turning for 20 minutes, empty the bath, bring out and lay out the hides. | |

If the leathers are designed to have dark colors, it is possible to add or replace a part of the zinc sulphate with copper sulphate. To give weight and a little firmness, it is also possible to add between 7 and 14% barium chloride.

The SANDOLIX WWL can be replaced by any emulsifier containing a percentage of sulphated or sulphonated oil, and even of sulfited oil.

In the case of sheepskins intended to make linings, it is not necessary to add any tawing, but it is recommended to add 0.6% of sodium undecylenate at the same time as the 2-phenylphenol. This operation is done under heat but can also be done cold without a bath.

EXAMPLE 5

Special method for sole leather

The raw material can also be insole leather, leathers with welts or leather substitutes.

weigh the wetted leathers and place them in the fuller with:

| | |
|---|---|
| water | 80% |
| zinc sulphate | 6% |
| turn for 60 minutes and add: | |
| barium sulphide | 5.80% |
| turn for 60 minutes and add: | |
| Sodium diethyldithiocarbamate | 0.2% |
| set the fuller turning for 30 minutes, | |
| empty the bath; | |
| rinse for 10 minutes in cold water, | |
| drain and bring out the hides. | |

For rather dark hides or hides due to be finished in dark colors, it is possible to replace all or part of the zinc sulphate with copper sulphate. This method has the advantage of not forming hygroscopic salts in the leather or at least minute quantities.

It is possible to replace the sodium diethyldithiocarbamate with sodium bensuldazate.

The invention is in no way limited to the examples described hereinabove and on the contrary various modifications can be brought thereto without departing from its scope.

What is claimed is:

1. Leathers and hides having biostatic properties with no migration of the active agent, having fixed in situ formed non-soluble basic metallic complexes, and on which have been fixed at least one biocidal agent.

2. Leathers and hides as claimed in claim 1, wherein the non-soluble basic metallic complexes, with a tanning activity, are formed in situ on the leather or hide by reacting two water-soluble salts.

3. Leathers and hides as claimed in claim 1, wherein the said non-soluble basic metallic complexes, with a tanning activity, are formed in situ on the leather or hide by fixing a salt insoluble in water but soluble in an emulsible solvent of a basic nature.

4. Leathers and hides as claimed in claim 1, wherein the biocidal agent is used in water-soluble form or in solution in a solvent.

5. Leathers and hides as claimed in claim 1, wherein conventional tanning agents are also used.

6. Leather and hides as claimed in claim 1, wherein the anions of the metallic salt used to form said complex are selected from the following: Sulphur derivatives: sulphate, thiosulphate, sulphites, hydrosulphites, sulfides, Selenium derivatives: from selenates to selenides, Tellurium derivatives: from tellurates to tellurides, Phosphorous derivatives: phosphates, phosphites, phosphides, Silicon derivatives: mainly silicates, fluosilicates and derivatives, Tin derivatives: mainly stannates and derivatives thereof, Bismuth derivatives: bismuthate and derivatives.

7. Leathers and hides as claimed in claim 1, wherein the cations of the metallic salt used to form said complex are selected from the following:

titanium, vanadium, manganese, cobalt, nickel, molybdenum, tungsten, thallium, bismuth, indium, tin, beryllium, magnesium, calcium, strontium and barium cations, chromium, iron, zirconium and aluminum cations used in non-soluble basic complex form.

8. Leathers and hides as claimed in claim 1, wherein the cations of the metallic salt used to form said complex used are selected from copper, zinc or silver cations.

9. Leathers and hides as claimed in claim 4, wherein the biocidal agents is selected from the following:

naphtenic acid and its salts, dimethylthiocarbamic acid and its salts, dimethyldithiocarbamates, ethylene, dithiocarbamate, ethylxanthate, isopropylxanthate, ethylphenyldithiocarbamate, undecylenic acid and undecylenates, hydroacetic acid and dehydroacetates, phenoxyacetic acid and phenoxyacetates, nitrophenoxyacetic acid and nitrophenoxyacetates, cresylic acid (cresol) and cresylates, bensuldazic acid and bensuldazates, 2-phenylphenol and its salts, pentachlorophenol, and its salts, tetrachlorophenol, triphenylantimony, triphenylbismuth, trimethyl-tin, paranitrophenols, and paranitrophenates, 3-methylchlorophenol (p. chlorometaxylenol), chloromercuriphenol (mercurobutol) and chloromercuriphenates, silicyanilide griseofulvin, amphotericin, nystatin, flucytosine, siccanin, bacitracin, essential oil of Artemesia Capillaris, 0-chloro-$\alpha,\alpha$-diphenylbenzylimidazole, miconazole econazole, haloprogine, 2-chloro-4-nitrophenol, 1,2bis-(ethoxycarbonyl)-thioureidobenzene, 6-chloro 1,2-benzoiiosthiazoline-3-one (ticlatone), fongeryl, gentian violet, eosin and eosinates.

* * * * *